US005732952A

United States Patent [19]

Joseph

[11] Patent Number: 5,732,952

[45] Date of Patent: Mar. 31, 1998

[54] BASEBALL-RELATED BUCKET GAME

[76] Inventor: Edward A. Joseph, Five Lefferts Rd., Yonkers, N.Y. 10705

[21] Appl. No.: 802,057

[22] Filed: Feb. 19, 1997

[51] Int. Cl.[6] ..... A63B 67/00

[52] U.S. Cl. ..... 273/317.6; 273/400

[58] Field of Search ..... 273/317.6, 108.3, 273/342, 353, 398, 400, 401, 402, 338

[56] References Cited

U.S. PATENT DOCUMENTS

| | | | |
|---|---|---|---|
| 1,325,436 | 12/1919 | Cressman | 273/342 |
| 2,287,113 | 6/1942 | Markey | 273/401 |
| 2,802,667 | 8/1957 | Bertley | 273/400 X |
| 2,850,283 | 9/1958 | Lemelson | 273/108.3 X |
| 5,056,797 | 10/1991 | Hockert et al. | 273/402 |
| 5,620,185 | 4/1997 | Robertson | 273/338 |

*Primary Examiner*—William H. Grieb
*Attorney, Agent, or Firm*—Kilgannon & Steidl

[57] ABSTRACT

This invention relates to a game of skill wherein baseball-shaped spheres are thrown or tossed at open buckets or containers from a starting area removed from the buckets. A score is attained by depositing the sphere in the bucket. The buckets are of varying size and value; the largest bucket representing the lowest value and successively smaller buckets having an increasing value. Also, the necessary degree of skill may be enhanced by having each of the successively smaller buckets disposed at a distance further removed from the starting area, or the necessary degree of skill may be enhanced by a combination of bucket opening size and distance from the starting area.

12 Claims, 3 Drawing Sheets

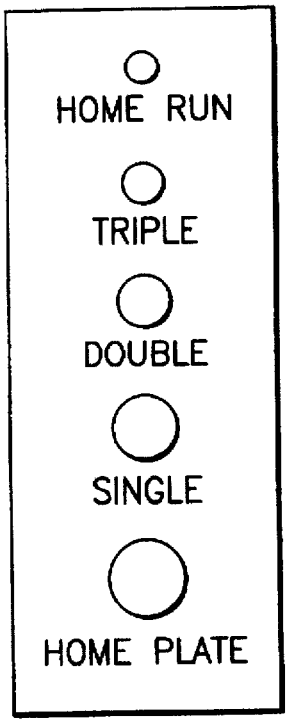
FIG. 4
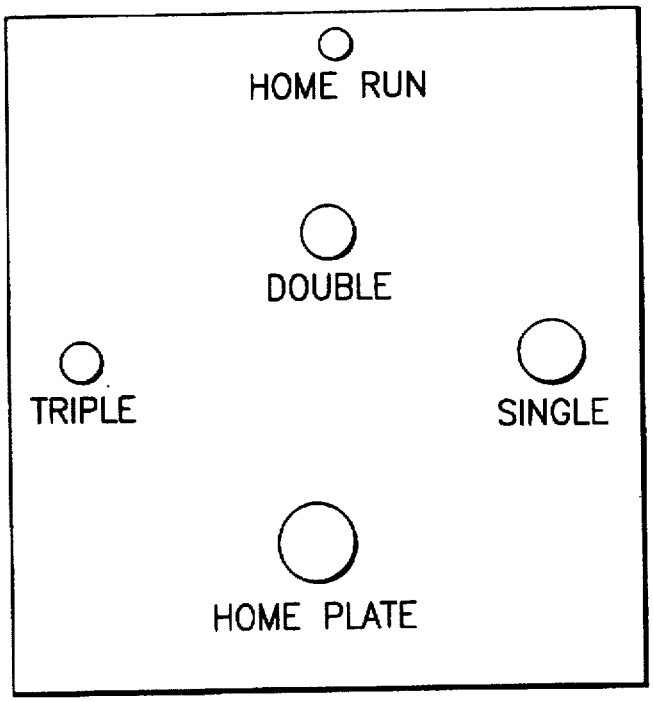
FIG. 6
FIG. 5
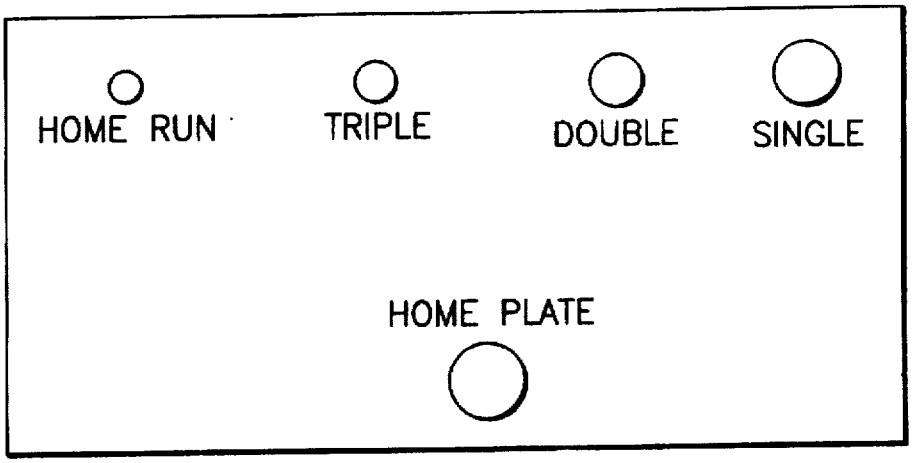

BASEBALL-RELATED BUCKET GAME

BACKGROUND OF THE INVENTION

This invention relates to a game of skill wherein baseball-shaped spheres are thrown or tossed at open buckets or containers from a starting area removed from the buckets. A score is attained by depositing the sphere in the bucket. The buckets are of varying size and value; the largest bucket representing the lowest value and successively smaller buckets having an increasing value. Also, the necessary degree of skill may be enhanced by having each of the successively smaller buckets disposed at a distance further removed from the starting area, or the necessary degree of skill may be enhanced by a combination of bucket opening size and distance from the starting area.

There are a number of games involving the tossing and rolling of a spherical object toward a hole in a playing surface in which an attempt is made to have the ball enter a hole or cup either directly, by being thrown from the tossing area or rolling back down an incline toward the cup. None has been found wherein the skill involved is tossing an object directly at the opening of a plurality of containers or buckets having varying sized openings.

SUMMARY OF THE INVENTION

The game of this invention is baseball-related and comprises arranging four buckets of varying value (single, double, triple and home-run) in an array distant from a starting area (home plate)). Additionally, the buckets vary in the diameter of the opening of each bucket, the largest diameter representing, in baseball parlance, a single, and each successive bucket having a decreased diameter opening, representing a double, a triple and a home run, respectively.

The object of the game is to throw or toss a baseball-shaped sphere from a starting area (home plate) toward the buckets, with success being measured by delivering the tossed sphere within the bucket. Each participant may direct the toss to any of the denominated buckets and continue the sequence of tosses until such time in each sequence (turn at bat), that the participant is unsuccessful on three tosses.

A score is determined for each participant and sequence of the participant by assigning a value of one to four (1 to 4) for each successful deposit of the tossed sphere into a bucket, a single having a value of one, a double a value of two, a triple a value of three and a home run a value of four and dividing the total value for the participant by four to determine the number of sets of four attained by the participant prior to ending the sequence by having a total of three misses. Each set, totalling four within the sequence, represents a "run." For example, if Participant A successfully tosses a sphere into the home run bucket and two spheres into the double bucket, the total point value is eight (8); four (4) for the home run and two (2) each for each of the doubles. Since there would be two sets of four, Participant A would have scored two runs. If Participant B, in his sequence, successfully tosses a sphere for a home run, two spheres for two doubles and two spheres for two singles, the total points would be ten (10) but Participant B would have only scored two runs for reason that ten points only has two sets of four. In the case of Participant B, it would amount to having left "men on the bases." For each sequence (time at bat), a score is determined for each participant and at the terminus of the pre-determined sequences, the game is over, and the participant with the highest number of runs is the winner.

Alternatively, the scoring system may use a multiple of the values one to four (1 to 4), with the highest total score being the winning participant. For example, the smallest bucket opening may be given a value of five (5), and successive larger opening buckets a value of ten, fifteen and twenty (10, 15 & 20); the participant with the highest total score being the winner.

BRIEF DESCRIPTION OF THE DRAWINGS

FIG. 4 is an embodiment of a dispositional arrangement of the starting area and the buckets of the game of this invention.

FIG. 5 is a second embodiment of a dispositional arrangement of the starting area and the buckets of the game of this invention.

FIG. 6 is a third embodiment of a dispositional arrangement of the starting area and the buckets of the game of this invention.

DETAILED DESCRIPTION

Figure 1:
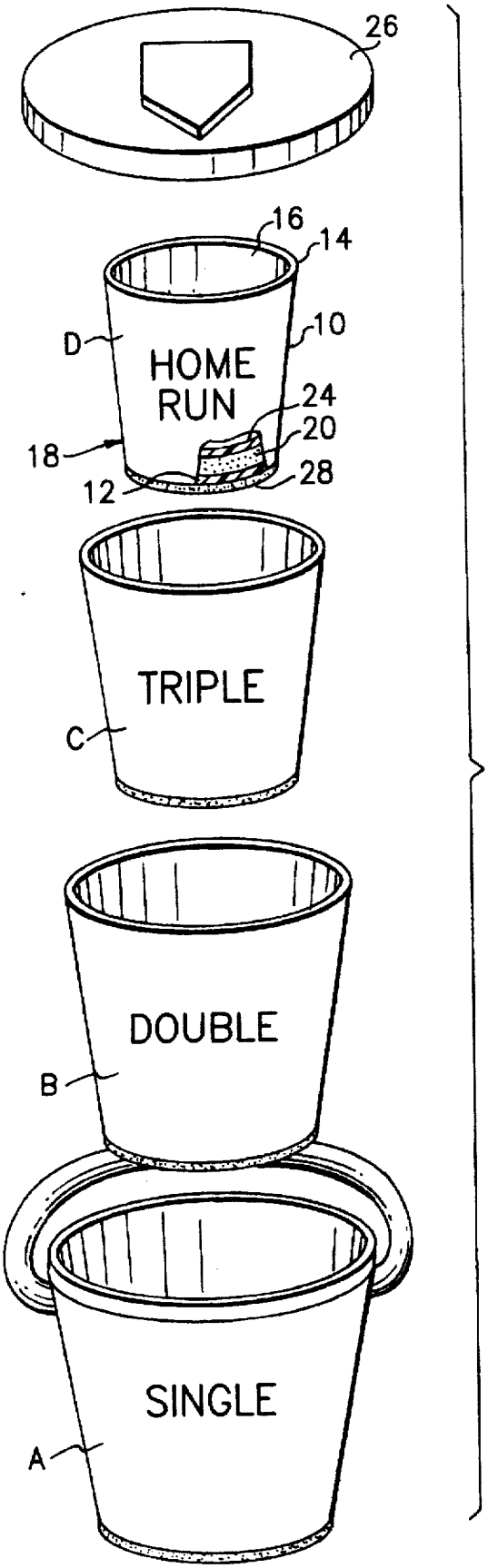
FIG. 1 is a perspective view of a set of buckets of successively smaller diameter openings.

With reference to the accompanying drawings, in FIG. 1, each of buckets "A"–"D" has an annular side wall 10 and a bottom 12, the top 14 of the annular wall 10 defining an opening 16 in each bucket. Each of the buckets "A"–"D" has a weighted bottom portion 18, which as shown in FIG. 1 is formed by having a zone 20 filled with sand 22 held in place between the upper surface of the bottom 12, the annular wall 10 and an upper layer 24.

The buckets may be constructed of any sufficiently rugged material of construction but, preferably, are constructed of plastic. Rather than sand 22, the weighted bottom portion 18 of the bucket may be achieved by molding metal weights into the plastic defining the zone 20.

Additionally, the buckets "A"–"D" are provided with a slip-resistant bottom surface 28, such as, for example, a layer of rubber matting. In the preferred form, the buckets are made in a highly visible color, most preferably of a different highly visible color for each of buckets "A"–"D." The buckets "A"–"D" have embossed or otherwise bear, in a clearly visible manner, the appropriate designation of "single," "double," "triple" and "home run" or other appellation indicating a different value for each of the buckets, with the value of the bucket increasing as the diameter of the bucket opening decreases.

The starting area (home plate) 26 may also serve as a cover for the four buckets when disposed within one another, the cover fitting by snap or other affixment means to the bucket with the largest diameter opening.

Figure 3:
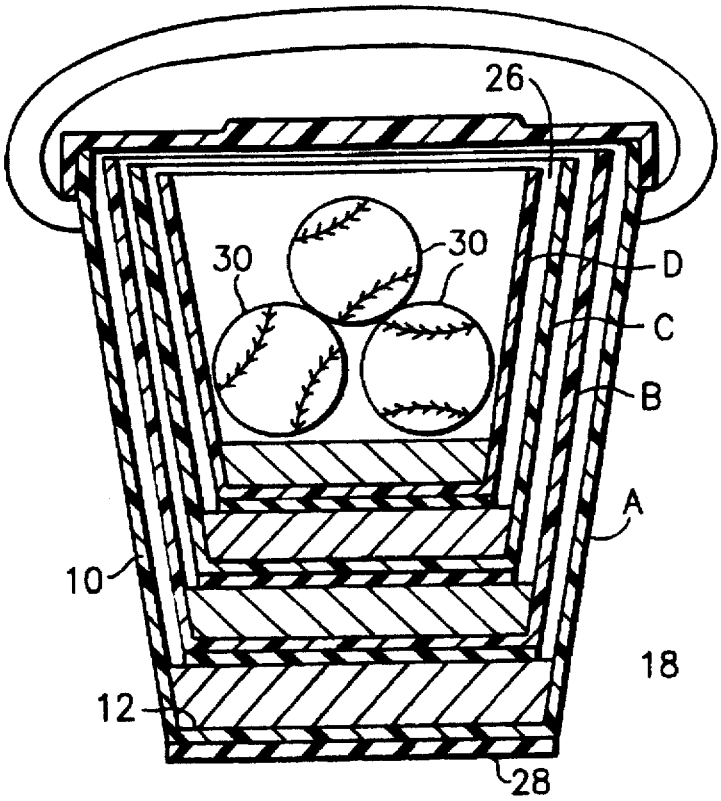
FIG. 3 is a cross-sectional view of a set of the buckets disposed within each other and with the starting area (home plate) cover in place on the largest bucket.

As shown in FIG. 3, the buckets "A"–"D" fit one inside the other, and together with the cover 26, form a complete unit, the largest bucket "A" being fitted with a handle to carry the ensemble.

Figure 2:
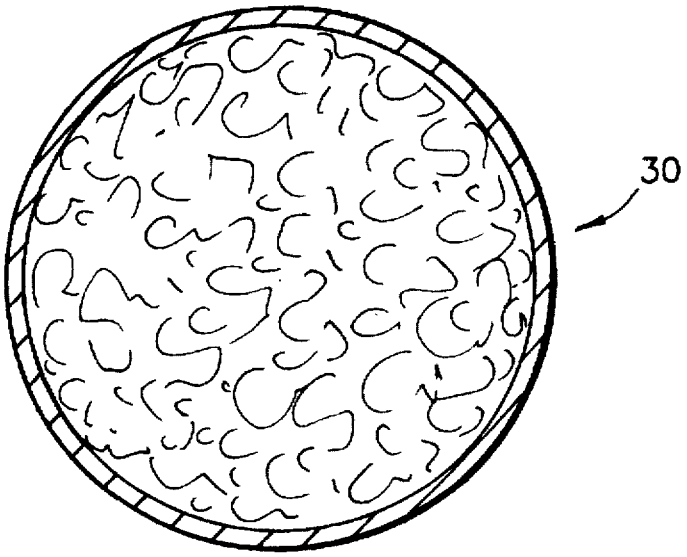
FIG. 2 is a cross-sectional view of a baseball-shaped sphere to be tossed at the open buckets by the game participants.

FIG. 2 shows a baseball-shaped sphere generally designated as 30, the sphere being non-resilient. The non-resilience may be achieved by filling the cover of the baseball-shaped sphere, for example, with a bean bag type material. Any number of non-resilient spheres may be provided. To keep the game moving at a faster pace, a sufficient number of spheres should be provided such that spheres do not have to be retrieved from a bucket or the playing field in order to complete a participant's sequence or turn at bat. Obviously, the minimum number of spheres necessary for the completion of a single sequence by a participant without the necessity of retrieving a sphere is three; i.e., if the participant misses three throws.

In the preferred embodiment, the buckets shown in FIGS. depict different arrangements of the buckets "A"–"D" in relation to the starting area (home plate).

Regarding the rules of the game: a team may be composed of one or more participants. The starting area is settled and the buckets "A"–"D" arranged in one of the arrays of FIGS. 4–6 or another array. As a general rule, the bucket with the smallest opening is disposed the greatest distance from the starting area (home plate) although this need not be the case. However, the placement of the buckets should be consistent with the premise that the greater degree of difficulty earns the greater reward (value of the bucket). For example, in the array shown in FIG. 5, the single and the home run are equidistant from the starting area, however, the home run still has a greater degree of difficulty for reason that the opening of the home run bucket is considerably smaller than the opening of the single bucket.

Many possible embodiments may be made without departing from the scope hereof; it is to be understood that all description herein set forth or shown in the accompanying drawings is to be interpreted as illustrative and not in a limiting sense.

I claim:

1. A game for two or more players having a baseball-related identity, comprising:

(a) a playing surface;

(b) a designated starting area (home plate) on the playing surface;

(c) four non-tippable buckets arrayed on the playing surface, each having an increased diameter opening and spaced from the starting area; the largest opening bucket being marked to represent a single and each other bucket having a successively smaller opening than the bucket representing a single, being marked to represent a double, triple and home run, respectively;

(d) non-resilient, baseball-shaped spheres which are substantially smaller than the smallest bucket opening.

2. The surface arrangement of claim 1, and further wherein the three buckets representing a single, double and triple are arranged in a baseball diamond array and the bucket representing a home run is positioned beyond the bucket representing a double on a line from the starting area (home plate) through the bucket representing a double.

3. The surface arrangement of claim 1, and further wherein the four buckets are each set at a greater distance from the starting area, in a format that successively smaller bucket openings are disposed at a greater distance from the starting area.

4. The surface arrangement of claim 1, and further wherein the buckets are arranged in a line substantially equidistant from a straight line extending laterally from the starting area and paralleling an imaginary line through the buckets.

5. A method of using a sphere-tossing game having a baseball-related identity, said toss game comprising:

(a) arranging on a suitable surface four non-tippable open buckets, each bucket having an increased diameter opening and representing the order of decreasing diameter opening, as a single, a double, a triple and a home run; said single, double, triple and home run being assigned a relative point value of 1, 2, 3 and 4, respectively, or any multiple thereof;

(b) disposing a starting area (home plate) at a distance from the arranged buckets;

(c) having at available non-resilient baseball-shaped spheres;

(d) said method further including the steps of: positioning the player at or behind the starting area and having the player toss the non-resilient, baseball-shaped spheres toward the respective buckets until the player fails three times to deposit the baseball-shaped spheres in one of the respective buckets, the tossing of the spheres and the three misses constituting a sequence, successive players each repeating the tossing of the baseball-shaped spheres at the buckets until three misses occur; repeating successive sequences for each player for a number of sequences to constitute a complete game.

6. The method of claim 5 and further wherein a total point value is determined for each participant, and further wherein the winner of the game is determined by dividing the total value for each participant in each sequence by four and adding the resultant quotients calculated to the lowest whole number of said quotient for each of the sequences, the highest total quotient being the winner.

7. The method of claim 5 and further wherein a total point value is determined for each participant and the winner of the game is the participant with the highest point value.

8. The method of claims 5 or 6 or 7 and further wherein the three buckets representing a single, double and triple are arranged in a baseball diamond array and the bucket representing a home run is positioned beyond the bucket representing a double on a line from the starting area (home plate) through the double bucket.

9. The method of claims 5 or 6 or 7 and further wherein the four buckets are each set at a greater distance from the starting area, in a format that successively smaller bucket openings are disposed at a greater distance from the starting area.

10. The method of claims 5 or 6 or 7 and further wherein the buckets are arranged in a line substantially equidistant from a straight line extending from the starting area and paralleling an imaginary line through the buckets.

11. An apparatus for a baseball-shaped sphere tossing game that is baseball-related, comprising four non-tippable buckets each having a decreasing diameter opening, which buckets are stored within one another, the largest bucket bearing an indicia indicating that it represents a single, and successive buckets of decreasing diameter opening bearing an indicia of a double, a triple and a home run, respectively, a plurality of baseball-shaped spheres disposed with the bucket ensemble and a cover for the largest diameter opening bucket, which cover has an indicia indicating that the cover represents a starting area (home plate).

12. The apparatus of claim 11 and further comprising a handle affixed to the outer bucket for carrying the ensemble of buckets and spheres.

* * * * *